United States Patent [19]

Baigas, Jr. et al.

[11] Patent Number: 4,562,675

[45] Date of Patent: Jan. 7, 1986

[54] WINDOW ASSEMBLY WITH LIGHT TRANSMISSIVE INSULATOR AND METHOD

[75] Inventors: Joseph F. Baigas, Jr.; C. Carey Hobbs, both of Waco, Tex.

[73] Assignee: Clark Bros. Felt Co., Groesbeck, Tex.

[21] Appl. No.: 516,660

[22] Filed: Jul. 25, 1983

[51] Int. Cl.[4] ..... E06B 3/26

[52] U.S. Cl. ..... 52/202; 52/203; 52/404; 52/511; 52/789; 160/DIG. 7

[58] Field of Search ..... 52/DIG. 13, 202, 203, 52/309.4, 309.8, 309.9, 404, 506, 511, 789, 746, 406; 160/DIG. 7; 428/290, 430

[56] References Cited

U.S. PATENT DOCUMENTS

| | | | |
|---|---|---|---|
| 2,298,783 | 10/1942 | Burnett | 20/40 |
| 2,381,542 | 8/1945 | Hyatt et al. | 160/DIG. 7 |
| 2,957,793 | 10/1960 | Dickey | 154/100 |
| 3,251,399 | 5/1966 | Grossman | 160/180 |
| 3,358,408 | 12/1967 | Cooper, Jr. et al. | 52/202 |
| 3,616,470 | 11/1971 | Young et al. | 5/337 |
| 3,753,458 | 8/1973 | Lazarek | 160/354 |
| 3,913,655 | 10/1975 | Ogino | 160/84 R |
| 4,035,215 | 7/1977 | Goldstone | 156/245 |
| 4,039,709 | 8/1977 | Newman | 428/159 |
| 4,068,428 | 1/1978 | Petersen, III | 160/354 |
| 4,186,234 | 1/1980 | Sakashita et al. | 428/283 |
| 4,224,373 | 9/1980 | Marzocchi | 428/288 |
| 4,237,180 | 12/1980 | Jaskowski | 428/280 |
| 4,249,589 | 2/1981 | Loeb | 160/368 R |
| 4,255,485 | 3/1981 | Yau | 428/288 |
| 4,256,808 | 3/1981 | Roy et al. | 428/421 |
| 4,294,879 | 10/1981 | McHenry | 428/288 |
| 4,342,807 | 8/1982 | Rasen et al. | 428/180 |
| 4,358,488 | 11/1982 | Dunklin et al. | 160/DIG. 7 |

*Primary Examiner*—Donald G. Kelly
*Assistant Examiner*—Creighton H. Smith
*Attorney, Agent, or Firm*—Bell, Seltzer, Park and Gibson

[57] ABSTRACT

A window assembly which includes a light transmissive heat insulator. The insulator is comprised of a high loft body of bonded together synthetic staple fibers and a plastic film adhered thereto. The window assembly with its insulator has a heat resistance R value of at least about 3 while also being substantially transmissive to incident light.

17 Claims, 8 Drawing Figures

WINDOW ASSEMBLY WITH LIGHT TRANSMISSIVE INSULATOR AND METHOD

FIELD AND BACKGROUND OF THE INVENTION

This invention relates generally to an insulated window assembly, and more particularly to a light transmissive heat insulator adapted for use in same, as well as a method of manufacturing the insulator.

Panels made of transparent glass or plastic have typically been used in window construction because of their light transmissive nature. Such panels, however, are poor heat insulators. Accordingly, various efforts have been made, particularly in recent times, to more effectively heat insulate such windows.

One approach has been to provide a second layer of transparent glass or plastic adjacent the windows such as in the form of a storm window or a double-paned thermal window. Storm windows and thermal windows do provide improved heat insulation, but they are both relatively expensive. Also, storm windows are typically heavy and difficult to install, and thermal windows are generally unsuited for installation in existing structures.

Another approach has been to apply some sort of heat insulative material directly to the surface of the window or spaced a short distance therefrom. This approach has included the use of thermal drapes or thermal window blinds which are relatively expensive and suited only to compatible installations. Such drapes and blinds are typically opaque, however, so that they serve to essentially eliminate the desired light transmissive nature of the window.

This approach has also included using rigid panels of thermally insulating materials to cover and heat insulate the window areas. These panels are also typically undesirably opaque, as well as usually being heavy and difficult to install, and expensive. Furthermore, the thermal insulating drapes, blinds and panels of this approach have also typically been constructed of materials that are not sufficiently fire resistant.

SUMMARY OF THE INVENTION

The foregoing shortcomings and deficiencies are met by the present invention which relates generally to an insulated window assembly. This assembly is characterized by having a light transmissive heat insulator which is positioned onto the window surface. This insulator, which is comprised of a high loft body of bonded together synthetic fibers and a sheet of plastic adjacent thereto, has heat insulative properties with an in use R value of at least about 3, while also being transmissive to incident light.

With its high loft body the insulator is light weight and easy to handle and desirably also flexible so that it will conform to the shape of the window being insulated and may be closely positioned thereto.

It is another object of the invention to provide an insulator that is fire resistant.

It is a further object of the invention to provide an insulator that is moisture resistant and easily cleaned.

It is a further object of the invention to provide a window insulator which can be easily secured to the window and, if desired, detached therefrom.

It is a further object of the invention to provide a method for manufacturing a window insulator.

Further and more specific objects and advantages of the invention will become apparent as the description progresses.

BRIEF DESCRIPTION OF THE DRAWINGS

Some of the objects and features of the invention having been stated, others will become more apparent as the description proceeds, when taken in connection with the accompanying drawings in which.

DETAILED DESCRIPTION OF THE INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
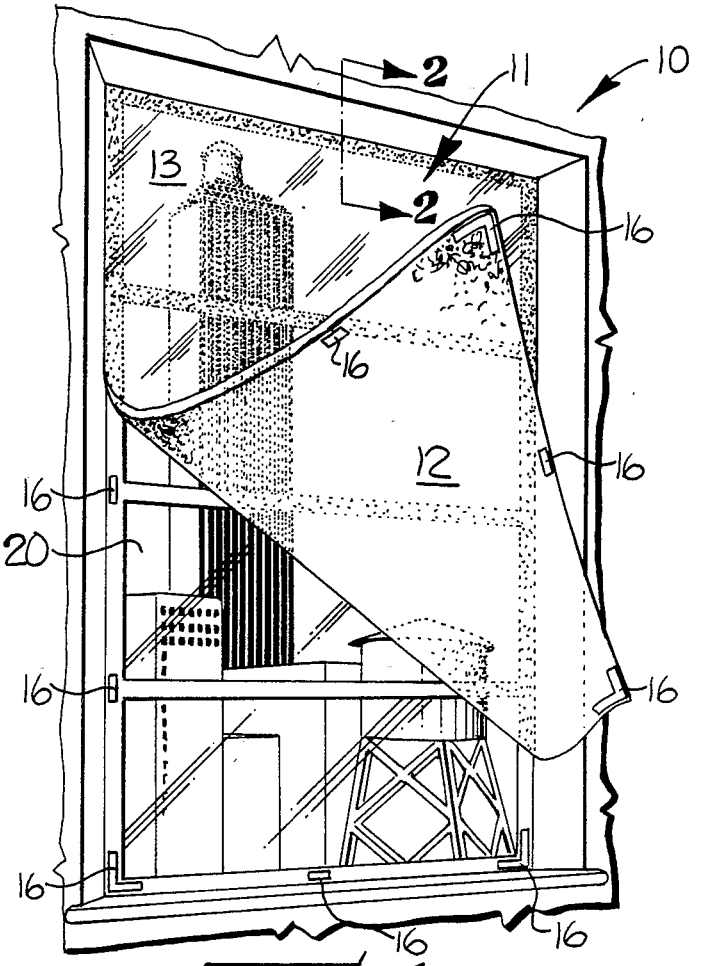
FIG. 1 is a perspective view of the window assembly and insulator of the invention in environmental setting.
Figure 2:
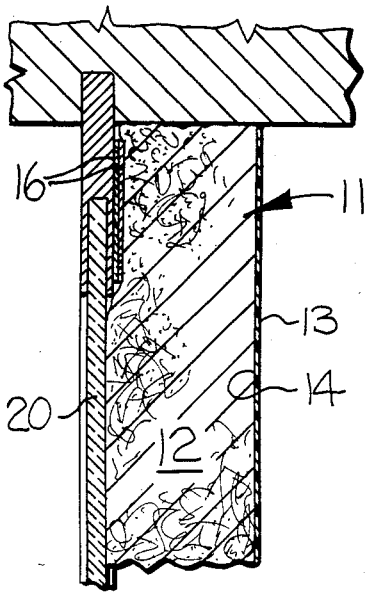
FIG. 2 is a partial sectional view along the line 2—2 of FIG. 1.

Referring now to FIGS. 1 and 2, the window assembly 10 of the invention is shown along with its basic components, window 20 and insulator 11. The insulator 11 comprises a high loft body 12 of bonded together synthetic fibers and a sheet 13 of transparent or translucent plastic material, as will be presently described in more detail adjacent the high loft body 12. As shown, the insulator 11 is positioned on the window 20 so that the high loft body 12 is sandwiched between the window 20 and the plastic sheet 13. So positioned, the high loft body 12 serves as a heat insulation barrier by essentially providing a dead air space between the window 20 and the plastic sheet 13. There is virtually no heat loss through convection or conduction across the area of the body 12.

Figure 8:
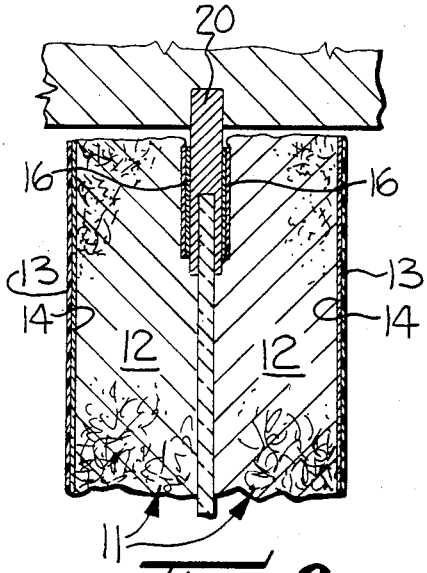
FIG. 8 is a partial sectional view illustrating the insulator of the invention applied to both sides of a window.

It is usually desired to install the insulator 11 on the interior side of the window 20 with the plastic sheet 13 exposed to the interior of the structure being insulated. So installed, the insulator 11 is protected from the elements of the weather and the environment. Nonetheless, for some applications it may be desired to install the insulator 11 on the exterior side of the window. The construction of the insulator 11 permits such an installation since it is preferably comprised of materials substantially weatherproof. Furthermore, since the exposed face of the plastic sheet 13 can be easily cleaned, soiling is only temporary and presents no significant problem. Along these same lines, additional heat insulation may be desired in some applications in which case the insulator 11 may be applied to both the interior and exterior sides of the window 20, as shown in FIG. 8, to essentially double the insulative effect.

To now refer more specifically to the preferred construction and materials of the window assembly 10 of the invention and the insulator 11 thereof, the window 20 being insulated is typically transparent to incident light and a relatively poor heat insulator with an R, heat resistance, value of about 1 or less. It is usually single layer glass, but may also be plastic. The window 20 may be one of several single units in a residence or may be a series of multiple units in a factory, school, office or greenhouse.

The plastic sheet 13 of the insulator 11 is light transmissive and preferably transparent. It may be a rigid and self-supporting plastic sheet but, preferably, it is a thin and flexible clear film which is secured to the side of the high loft body 12. It may be polyvinyl chloride or polyester and usually ranges from about 0.0005 to 0.003 inch in thickness. This sheet 13 is preferably impervious to moisture and vapor so that the face of the insulator 11 may be easily cleaned and so that the high loft body 12 will be protected in use.

The high loft body 12 of the insulator 11 is comprised of synthetic fibers bonded together usually in the form of a nonwoven batting. The bonding agent included in such a batting should form a hard tack-free film on the fibers, impart maximum resilience to the body, be resistant to ultraviolet degradation and still be light transmissive. Bonding agents found to have such properties are Rhoplex TR-407, HA-16 and HA-17 all of the Rohm and Haas Company, UCAR Latex 879 of Union Carbide Corporation, and Geon 450×60 of the B. F. Goodrich Company.

Figure 5:
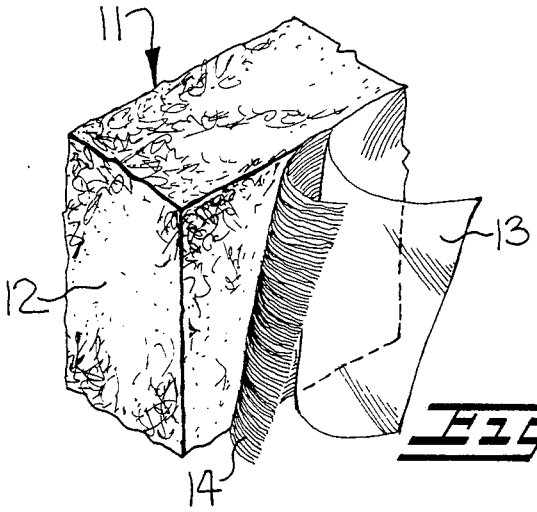
FIG. 5 is an exploded perspective partial view of a preferred form of the insulator of the invention.

The body 12 typically ranges in thickness from about 1 to 2 inches with the synthetic fibers usually being crimped polyester staple fibers in about a 50/50 blend of about 15 denier and about 6 denier fibers. These fibers typically range from about 2 to 3½ inches in length. The weight of the body 12 is relatively light and is in the range of from about 8 to 10 ounces per square yard and indeed the entire insulator is desirably of about the same weight. As noted above, the film of the plastic sheet 13 is preferably secured to the side of the body 12 covered by the plastic sheet 13. While conventional adhesive materials and lamination techniques may be used to effect such securement, they tend to undesirably distort and damage both the film and the high loft body 12 because of difficulty in applying them uniformly or because of the excessive heat required in their use. A preferred means of securement employs the use of an open mesh, netlike sheet of heat activatable hot melt adhesive material 14 (shown in FIG. 5). Known as Sharnet SH-3116 of Inmont Corporation, this material is a nonwoven sheet of synthetic material, preferably polyethylene. It has excellent adhesion to both polyvinyl chloride and polyester. Using a sheet of this material, the film may be uniformly laminated to the body 12 at a relatively low temperature (about 210° F.) which is greater than the melting temperature of the adhesive material and lower than the melting temperature of either the plastic sheet 13 or the fibers of the high loft body 12. This allows the sheet 13 to be secured to the high loft body 12 without appreciably distorting either the sheet 13 or the body 12.

Figure 3:
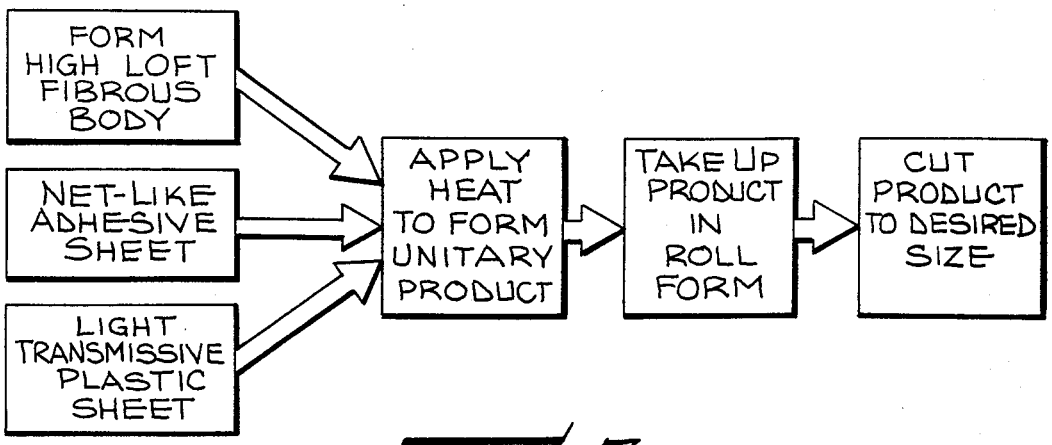
FIG. 3 is a block diagram depicting the steps of manufacturing an insulator of the invention.
Figure 4:
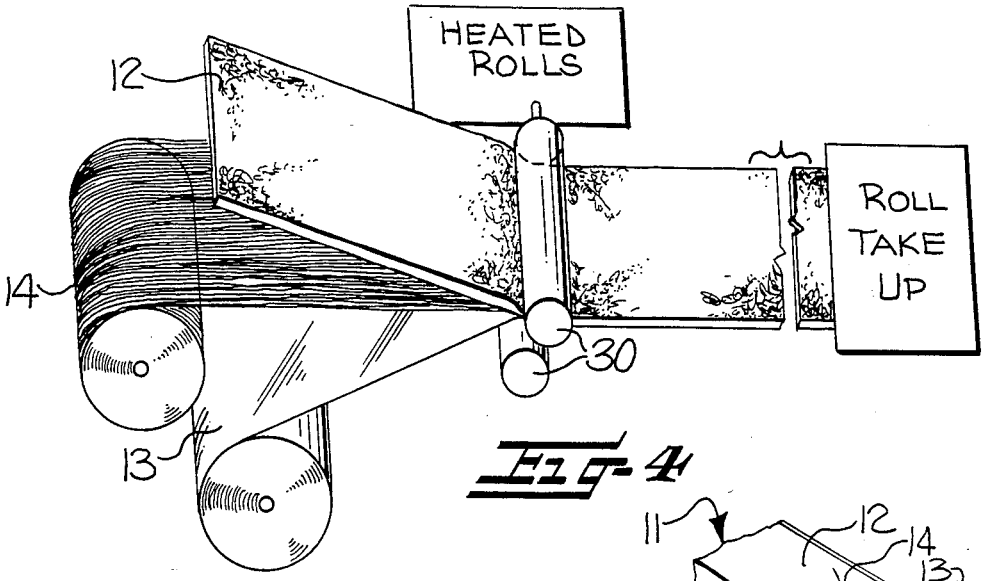
FIG. 4 is a schematic illustration of manufacturing a preferred form of the insulator of the invention.

Referring now to FIGS. 3 and 4, the desired manner of manufacturing the insulator 11 thus includes first forming a high loft body 12 of bonded together synthetic staple fibers. This may be done by air-laying, carding or garnetting the fibers and stabilizing them into the high loft body 12 by applying a resin bonding agent (more specifically described elsewhere herein) by such techniques as spray saturation or foaming. The body 12 is provided in a continuous length of a desired predetermined width, such as 36 inches.

Provided adjacent the body 12 and preferably aligned therewith is a continuous sheet of plastic film 13 of substantially the same corresponding width as the body 12 supplied usually from a roll. Also provided is a continuous sheet of the heat activatable hot melt adhesive material 14 described in more detail above. It likewise is usually supplied from a roll and may be of about the same width as the body 12, and it is introduced between the film 13 and the length of the body 11 in superimposed relation thereto.

The composite sandwich of plastic sheet 13, adhesive 14 and body 12 is then passed through a pair of heated nip rolls 30 wherein these widths of materials are simultaneously subjected to a predetermined pressure sufficient to momentarily compress them together and heated to the desired predetermined temperature so that the plastic sheet 13 is joined to the body 12 without appreciably distorting either of them. As described above, the materials are heated to a temperature which melts the adhesive but not the plastic sheet 13 or the fibers of the body 11.

This yields a continuous length of unitary heat insulator product which can then be taken up for packaging into a roll from which lengths may be removed and cut into sections of product of desired size. Or if desired, lengths of product may be immediately taken off after production and cut into sections of desired size and shape without being taken up into a roll.

Used in association with a desirably transparent window 20, the insulator 11 yields a window assembly 10 which is translucent and transmissive to incident light but still possesses relatively good heat insulative properties. Specifically, the assembly 10 with the insulator 11 has a heat resistence R value of at least about 3, while allowing the transmission therethrough of from at least about 40% to about 50% of incident light. In point of fact, even alone the insulator 11 possesses these general properties.

The insulator 11 described above is relatively fire resistant and well suited for general use in most applications in that form. In certain instances, however, greater fire resistance is desired, in which case changes to the above-described construction may be made as follows.

First of all, 100% polyester fibers are typically used in the high loft body 12 and such fibers produce a reasonably fire resistant insulator 11. If increased fire resistance is desired, a special fire resistant polyester fiber, such as Trevira 271 of Hoechst Fibers Industries, may be used in place of the ordinary polyester fibers. Alternatively, even better fire resistant properties may be obtained with a crimped fiber composition of 50% 15 denier polyester fibers, 30% 5.5 denier polyester fibers and 20% 5.5 denier Nomex aramid fibers of DuPont de Nemours.

In connection with varying the composition of the fibers of the body 12, a flame retardant substance may be added to the bonding agent for the fibers to improve fire resistance. For example, the bonding agent may comprise 4 parts latex emulsion (Geon 450×60 of the B. F. Goodrich Company), 4 parts water and 1 part flame retardant additive. That additive desirably is made up of an antimony oxide in the form of Nyacol A 1550 of Nyacol Products, Inc. (which is a colloidal dispersion of antimony pentoxide in water) and decabromodiphenyl oxide. These substances are provided in such quantities to give an antimony/bromine weight ratio of about 1, although this ratio may be varied to about one part antimony to three parts bromine by weight if desired.

Using polyvinyl chloride film as the material of the plastic sheet 13 of the insulator 11 provides generally satisfactory results since it is relatively fire resistant. The use of post-chlorinated polyvinyl chloride, such as TempRite CPVC 623×563 of B. F. Goodrich Company for this film, is most preferred, however, since it yields a film of enhanced fire resistance itself and also improves the overall fire resistance of the composite insulator 11 by contributing additional halogen ($Cl_2$) to the entire system.

An insulator 11 utilizing a high loft body 12 comprising the crimped polyester/Nomex aramid fibers and the fire retardant containing bonding agent described above and a plastic sheet 13 comprised of a post-chlorinated polyvinyl chloride film has an in use R value of approximately 3.33 when tested by the Guarded Hot Plate technique and will transmit at least about 40% to 45% of incident light. As far as fire retardant properties are concerned, such an insulator has a Flame Spread value of less than 25 and a Smoke Developed value of less than 100 using the Steiner Tunnel Test (ASTM:E-84).

Figure 6:
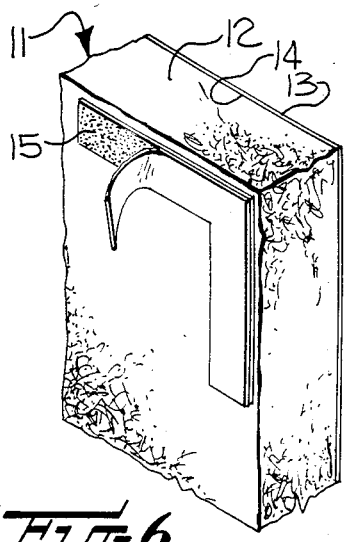
FIG. 6 is a perspective partial view of the insulator of the invention illustrating one attachment means for the insulator.
Figure 7:
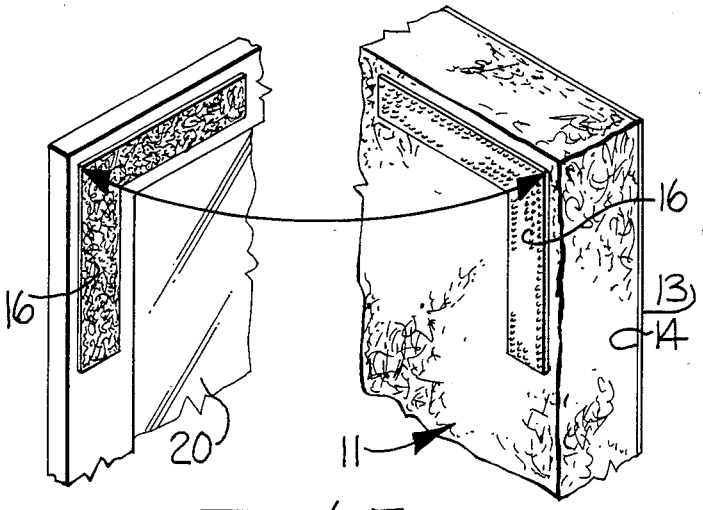
FIG. 7 is another perspective partial view similar to FIG. 6 illustrating another form of attachment means.

Referring now to FIGS. 6 and 7, the insulator 11 of the invention may be installed attached to window surfaces. It is lightweight and may be easily secured to the window 20 with strips of pressure sensitive tape 15 as shown in FIG. 6. Alternatively, if it desired to secure the insulation in such a fashion that it may be readily detached and reattached to the window 20 as desired, then portions of hook-and-loop type fasteners 16 shown in FIGS. 1, 2 and 7, and commonly referred to as Velcro, may be adhered to the window 20 and insulator 11 at predetermined locations to detachably secure the insulator 11 to the window 20. Also, if desired, the fasteners 16 may be only provided on the window 20 since when their projecting portions engage the high loft body 12 of the insulator 11 they will provide substantial securement.

As noted above, the plastic sheet 13 of the insulator is desirably a flexible film secured to the high loft body 12. So constructed, the entire insulator is flexible and will readily conform to the shape of a window 20 including surface irregularities thereon so as to fit closely thereto.

In the drawings and specification, there have been set forth preferred embodiments of the invention, and although specific terms are employed, they are used in a generic and descriptive sense only and not for purposes of limitation.

That which is claimed is:

1. A window assembly having heat insulative properties with an R value of at least about 3 characterized by being transmissive to incident light, said window assembly comprising a window, and an insulator extending along and covering one side of said window, said insulator comprising a high loft body of bonded together synthetic fibers and a sheet of plastic positioned to extend along and cover one side of said body of fibers, said high loft body having a thickness many times that of said sheet of plastic, and said insulator being positioned on said window so that the body of fibers is sandwiched between the window and said sheet of plastic.

2. The window assembly of claim 1 wherein said insulator is flexible to facilitate its positioning on said window and wherein said insulator is translucent such that the window assembly allows the transmission therethrough of at least from about 40% to about 50% of incident light.

3. The window assembly of claim 1 wherein the synthetic fibers of said high loft body comprise polyester and the weight of said body is relatively light and is from about 8 to about 10 ounces per square yard.

4. The window assembly of claim 3 wherein the synthetic fibers of said high loft body are crimped and comprise about a 50/50 blend of about 15 denier and about 6 denier fibers.

5. The window assembly of claim 1 wherein the sheet of plastic is a flexible film selected from a group consisting of polyvinyl chloride and polyester and wherein the sheet of plastic is secured to said body of fibers.

6. The window assembly of claim 1 wherein the sheet of plastic is a flexible film and wherein an open mesh, net-like sheet of heat activatable hot melt adhesive is provided for securing said plastic film to said body of fibers.

7. The window assembly of claim 6 wherein said net-like sheet of adhesive has a melting temperature that is lower than the melting temperature of said flexible film and of the fibers of said high loft body of fibers whereby said film may be secured to said body by heat without appreciably distorting said film or said body of fibers.

8. The window assembly of claim 3 wherein said bonded together synthetic fibers forming said high loft body include a bonding agent having a flame retardant to enhance the fire resistant properties of said insulator and wherein said plastic sheet comprises polyvinyl chloride to further enhance the flame resistant properties of said insulator.

9. The window assembly of claim 8 wherein said flame retardant comprises antimony pentoxide and decabromodiphenyl oxide.

10. The window assembly of claim 1 further comprising pressure sensitive tape to secure said insulator to said window and adhesive means for securing the sheet of plastic to the high loft body of said insulator.

11. The window assembly of claim 1 including means for detachably securing said insulator to said window.

12. The window assembly of claim 1 including an additional insulator of substantially the same type as the first mentioned insulator, and wherein said additional insulator is positioned on the opposite side of said window from said first mentioned insulator.

13. A window assembly having heat insulative properties with an R value of at least about 3 characterized by being transmissive to incident light, said window assembly comprising a window, and an insulator extending along and covering one side of said window, said insulator comprising a high loft body of bonded together synthetic fibers, said body of fibers comprising polyester and a flame retardant to enhance the fire resistant properties of said insulator, and a sheet of a flexible plastic film secured to said of fibers and positioned to extend along and cover one side of said body of fibers, said high loft body having a thickness many times that of said sheet of plastic, and said insulator being positioned on said window so that the body of fibers is sandwiched between the window and said sheet of plastic.

14. The window assembly of claim 13 wherein said insulator is flexible to facilitate its positioning on said window and wherein said insulator is translucent such the window assembly allows the transmission therethrough of from about 40% to about 50% of incident light.

15. The window assembly of claim 13 wherein the flame retardant comprises antimony pentoxide and decabromodiphenyl oxide and the plastic film consists of polyvinyl chloride to further enhance the flame resistant properties of said insulator.

16. The window assembly of claim 15 wherein said bonded together synthetic fibers forming said high loft body include aramid fibers and wherein the fibers of said body are crimped and comprise about a 50/50 blend of about 15 denier and about 6 denier fibers.

17. The window assembly of claim 16 wherein the polyvinyl chloride of the sheet of plastic film is post-chlorinated and wherein said insulator is so constituted as to have a flame spread value of not greater than about 25 and a smoke developed value of not greater than about 100.

* * * * *